US008624099B2

(12) United States Patent
Osborne

(10) Patent No.: US 8,624,099 B2
(45) Date of Patent: Jan. 7, 2014

(54) MUSICAL EFFECTS FOOT CONTROL

(76) Inventor: Andrew T Osborne, Toronto (CA)

( * ) Notice: Subject to any disclaimer, the term of this patent is extended or adjusted under 35 U.S.C. 154(b) by 135 days.

(21) Appl. No.: 13/373,620

(22) Filed: Nov. 22, 2011

(65) Prior Publication Data

US 2013/0125736 A1 May 23, 2013

(51) Int. Cl.
*G10H 1/32* (2006.01)

(52) U.S. Cl.
USPC ..... 84/721; 84/746

(58) Field of Classification Search
USPC ..... 84/746, 721
See application file for complete search history.

(56) References Cited

U.S. PATENT DOCUMENTS

| | | | | |
|---|---|---|---|---|
| 2,555,295 | A * | 5/1951 | Schmidt | 84/692 |
| 3,178,501 | A * | 4/1965 | Evans | 84/731 |
| 3,530,224 | A * | 9/1970 | Kushner et al. | 84/742 |
| 3,800,060 | A * | 3/1974 | Hallman, Jr. | 84/672 |
| 4,491,050 | A * | 1/1985 | Franzmann | 84/746 |
| 4,855,707 | A * | 8/1989 | Clement | 338/153 |
| 6,256,011 | B1 * | 7/2001 | Culver | 345/157 |
| 6,545,204 | B1 * | 4/2003 | Wadell | 84/422.1 |
| 6,611,250 | B1 * | 8/2003 | Prince et al. | 345/163 |
| 6,812,918 | B2 * | 11/2004 | Yang | 345/167 |
| 7,709,726 | B2 * | 5/2010 | Smith | 84/626 |
| 2003/0128186 | A1 * | 7/2003 | Laker | 345/156 |
| 2009/0056528 | A1 * | 3/2009 | Smith | 84/746 |
| 2009/0199700 | A1 * | 8/2009 | Goldstein | 84/746 |

* cited by examiner

*Primary Examiner* — David S. Warren

(57) ABSTRACT

A foot control for control of musical effects from a musical instrument, the instrument having an electrical signal output operable to send signals to a speaker system, the control having a housing with at least one side wall; a roller rotatably mounted in the housing, a roller surface portion exposed and extending away from the housing for contact by a foot, to enable rotation of the roller by the foot; and, circuitry within the base connectable with the instrument and operable in response to rotation of the roller, to vary signals from the instrument.

10 Claims, 5 Drawing Sheets

MUSICAL EFFECTS FOOT CONTROL

FIELD OF THE INVENTION

The invention relates to a foot control for a musical instrument, which can be operated by one foot to vary and or control various musical effects. In particular it relates to a movable foot control connected to the instrument, or to an electrical component in a sound system by a cable, and incorporating a roller control which can be rotated by one foot.

BACKGROUND OF THE INVENTION

It is well known to provide a variety of musical instruments with special controls which can vary the musical effects of the instrument. For example the piano has foot pedals which can vary the effects produced by the strings. Harps also incorporate such a foot pedal.

Electric guitars are also provided with a foot control device which can vary the effects of the guitar. Usually such foot controls have been in the form of a pedal of some kind. On a piano for example the pedal or pedals are pivoted on a column extending down beneath the piano, in a fixed location. The player is usually located, preferably seated, where he/she can reach the pedals Foot controls for a guitar are not incorporated in the guitar itself. The control is a separate component. It is connected to the guitar by an electric cable.

It can be positioned in a convenient location on the floor, close to the location of the player, who may be standing or seated.

This allows for greater flexibility in arranging the various players of different instruments, and also takes up less floor space than conventional controls.

However such movable controls have usually been based on some kind of pedal. Either the pedal was similar in operation to a piano pedal, i.e. it was hinged to a base, or the pedal was a sort of tilting see-saw device, with the foot resting on the surface.

In other cases the control was some kind of button which could simply be depressed or released.

These controls operated some form of electrical circuit. The range of movement of such a device was restricted by the range of swinging of the pedal about its tilt axis. As a result the of range of movement was limited.

This in turn resulted in the device providing a somewhat insensitive degree of control over the musical effect.

Clearly it is desirable to provide such a control in which the range of physical movement available for the control is greater than in such previous controls. This will enable the player to achieve a finer degree of control of variation.

Another disadvantage of known controls was that they were relatively bulky and heavy. Players of an instrument such as a guitar will want to move from one venue to another as freely as possible. Given that the instrument itself must be of a certain size, it is desirable that the auxiliary devices shall be as small and compact as possible, so as to render them easily portable when moved from place to place.

It is also desirable that, when in use such a control shall occupy a minimum floor area, or "footprint", or space on the control; board of the player, to avoid interfering with other players, and their equipment.

BRIEF SUMMARY OF THE INVENTION

With a view to answering the foregoing conflicting requirements, the invention provides a foot control for control of musical effects from a musical instrument, the instrument having an electrical signal output operable to send signals to a speaker system, said control comprising a base adapted to be placed on the floor, the base defining at least one side wall, a notch in the side wall, a roller rotatably mounted in the base and extending outwardly from the notch, and having a roller surface portion exposed away from the base for contact by a foot, and circuitry within the base connectable with the instrument and operable in response to rotation of the roller, to vary signals from said instrument.

Preferably the control will be of such design that it can withstand at least some of the body weight of the player.

Usefully the control will have a roller which is mounted on a horizontal roller axis, on an axle carried by the base.

Usefully the control will have housing or base of generally rectangular box like shape, defined by four side walls and a top wall, and the notch being formed in one side wall and in the top wall so that a curved side surface portion of the roller is exposed and extended outwardly from the base, for contact by the foot.

Usefully the control will have circuitry mounted within the box like housing shape, and a connecting cables as needed extending from the base for connection to the instrument, and to the speaker or other electrical equipment. Plug in jacks of conventional size as used in such equipment enables the device to be moved from one instrument, or from one component, to another, as needed.

Usefully the control will have at least one electrical component, typically a potentiometer, forming part of the circuitry, which is rotatable, and a gear or gears connecting the roller with the rotatable electrical component. This component, for example a potentiometer, may have a range or arc of movement of as much as 300 or more degs.

Usefully the control will have a drive gear on the roller axle, and a driven gear on the rotatable component, and at least one intermediate gear between the drive gear and the driven gear, the ratios of the gears being selected to provide a desired range of rotation of the rotatable electrical component.

Usefully the control may have a resilient member connected to the electrical rotatable component, which is biased to provide a predetermined rotational position.

In some cases is may be desirable to provide a non-horizontal rotational mounting for the roller, such as a vertical shaft, with the roller mounted on an end of the shaft extending above the base, or with a portion of the roller extending outwardly from the base to one side, for foot contact.

In this case the foot could rest on the flat side of the roller, and be operated by twisting the foot, rather than rolling the foot on the cylindrical surface of the roller.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
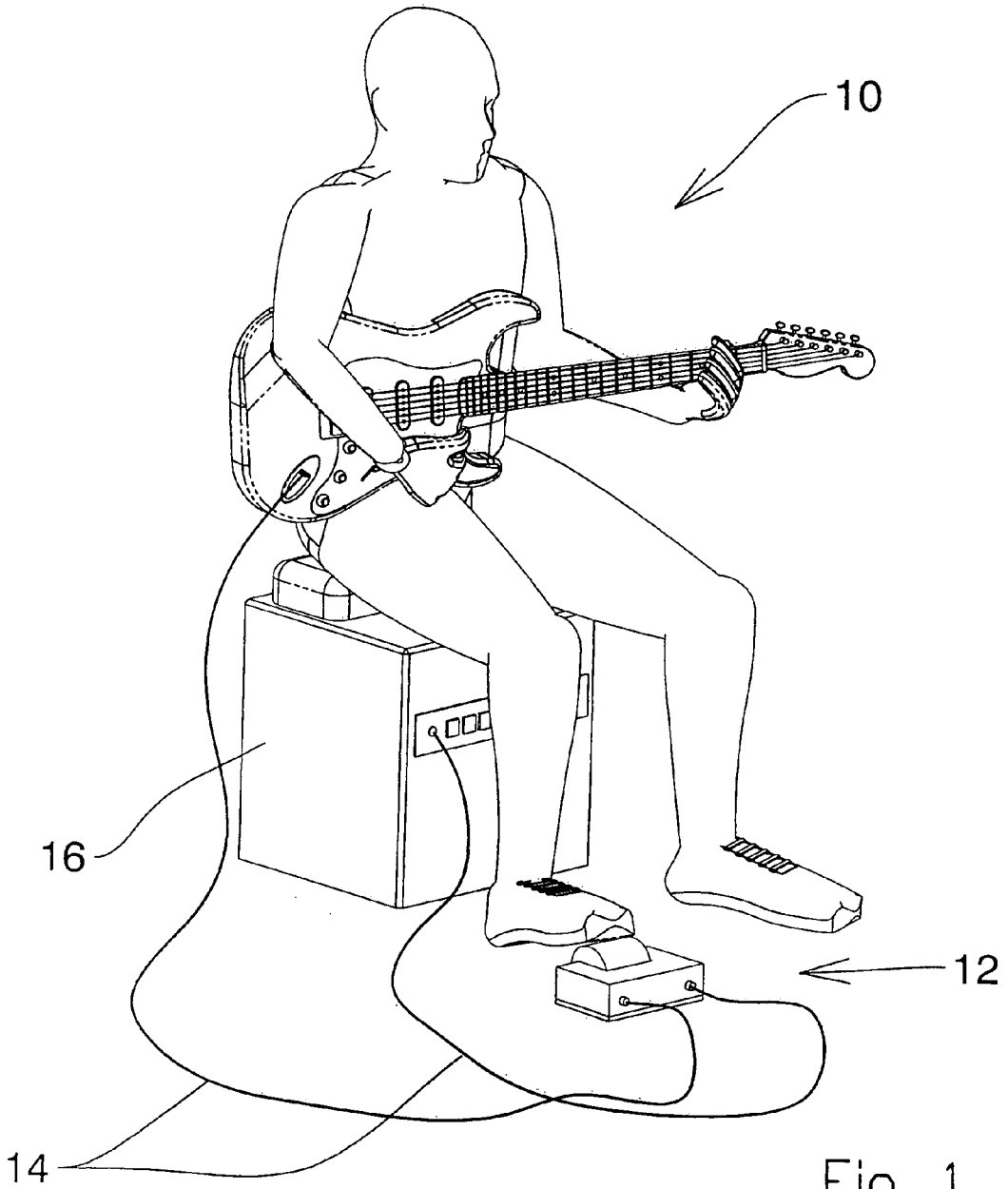
FIG. 1 is a general perspective showing a player with a guitar, and using a foot control illustrating the invention.

Referring to FIG. 1 it will be seen that the invention is illustrated here, in general, as being used in conjunction with an electric guitar. Such instruments are well know, and the details are not part of the invention. However in such an instrument, and in others in which electrical sound signals are produced it is customary to provide a foot control by which the effects of such signals can be varied. Electrical instruments other than electric guitars may also use a foot control for varying sound effects.

In FIG. 1 the instrument, in this case a electric guitar, is shown as (10). It is connected to the foot control (12) by an electrical connection cables (14).

The instrument is also connected to a speaker (16). There may be other electrical components such as an amplifier (not shown), connected as well, in known manner. The player will often be playing with a group. The space for the group may be restricted.

The foot controls available in the past have been large and cumbersome. They occupied significant space. They were also added weight. The range of control of such controls was limited.

The foot control illustrating the invention, in this case, comprised a housing (20) of generally rectangular shape. Within the housing there are electronic components indicated generally as (22) on a base plate (23). These components will be designed and specified to permit a range of variations in the musical effect of the instrument, or in some cases to control the parameters of other controls.

Such components may vary from one instrument to another. They may also vary, depending on the type of effect to be controlled. Thus the control may be simply the comparative sounds, such as volume, or tone, or they could be treble/bass sounds, or there may be any combination of effects, or other effect.

Such circuits and components are know per se, and require no special description. The variation in such control is produced by the control shaft (24) extending from the components (22). Rotation of the shaft will change the control effect.

In the present invention such rotation is procured by the roller (26)

Figure 2:
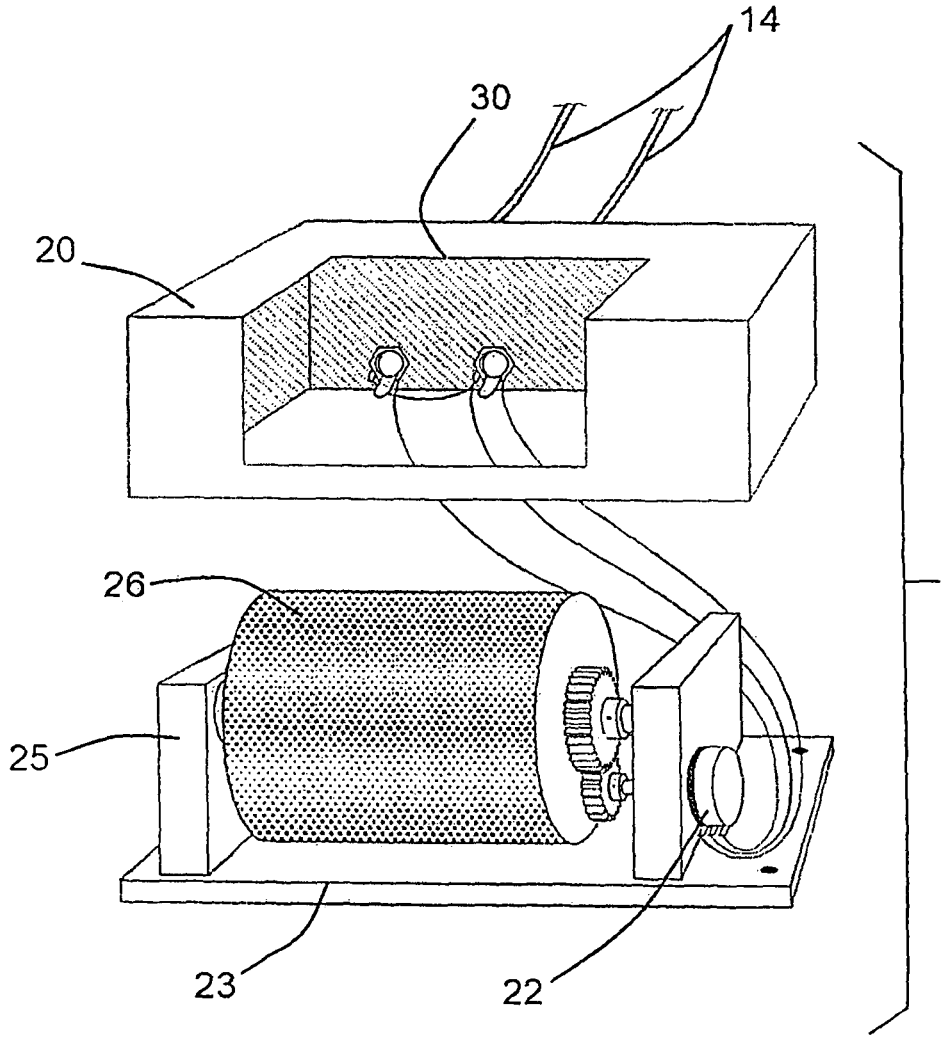
FIG. 2 is a perspective of the foot control of FIG. 1.
Figure 3:
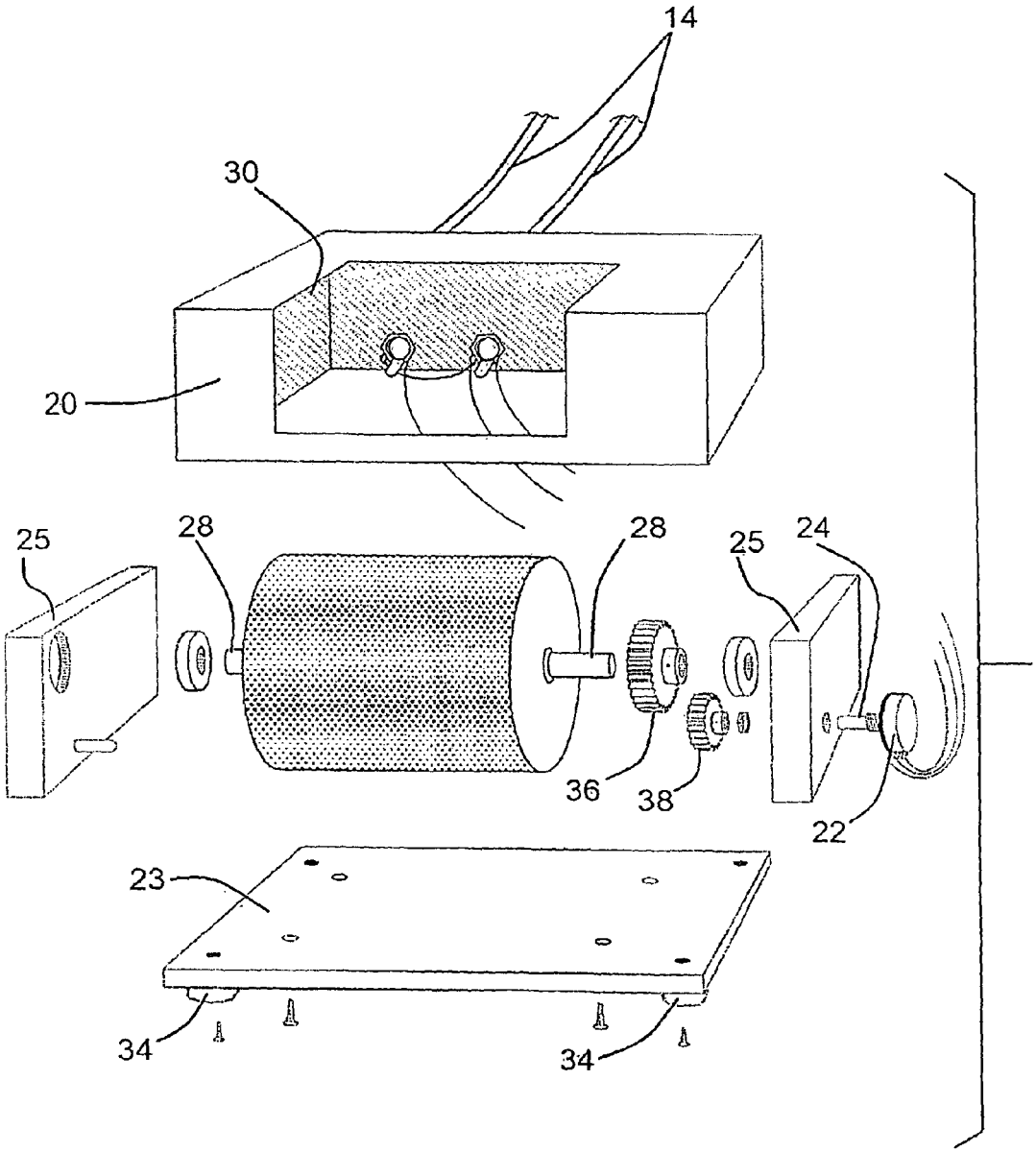
FIG. 3 is an exploded perspective of the foot control.

Roller (26), in the embodiment illustrated in FIGS. 1, 2, and 3 is mounted on a horizontal axle shaft (28) rotatably mounted between upright walls (25) which are secured to plate (23) in the housing (20).

Housing (20) is formed with an opening or recess, or notch (30), and the roller (26) is located within such opening. The axle (28) is positioned such that a portion at least of the roller (26) projects outwardly from housing (20). The radius of the roller is larger than the space between the roller axle and the edges of the housing. In this way the roller surface will project above and away from the housing, and is thus exposed for easy contact by the foot. Preferably the roller (26) will project both above and to one side of the housing (20). The axle will be strong enough to permit the player to rest his foot on the roller, during play.

To prevent accidental over rotation stop (32) may be provided to provide a limit to the arc of rotation of the roller.

It this way the roller (26) is readily accessible to the sole of a shoe, FIG. 1. By resting the shoe on the roller (26) and moving the shoe forward or back, the roller (26) can be rotated in either direction.

Floor friction elements (34) are provided on the underside of plate (23).

These may be of rubber, or for example, of Velcro (trade Mark) material, or any other suitable friction material.

Within housing (20) there is a gear train comprising a first drive gear (36) and a second driven gear (38). This is merely by way of example and illustration. The gear train could be only two gears, or could include three or more gears, depending on the choice of the components.

The function of the gear train is to transmit rotation of the roller (26) to the electronic component shaft (24), which in this case is a potentiometer.

In doing so the gear train will preferably, although not essentially, provide for a greater arc of rotation of the component shaft (24), than would be possible by a simple direct connection between the roller shaft (28) and the component shaft (24).

In this way the arc of operation of the roller itself, which may typically be limited, in order to permit operation by the foot, to between 90 and 180 degs, for example, will achieve a varying range of rotation of the component shaft (24), up to 300 or more degs if desired, and thus provide for a more precise degree of variation and a greater range of variation of the musical effect.

Figure 4:
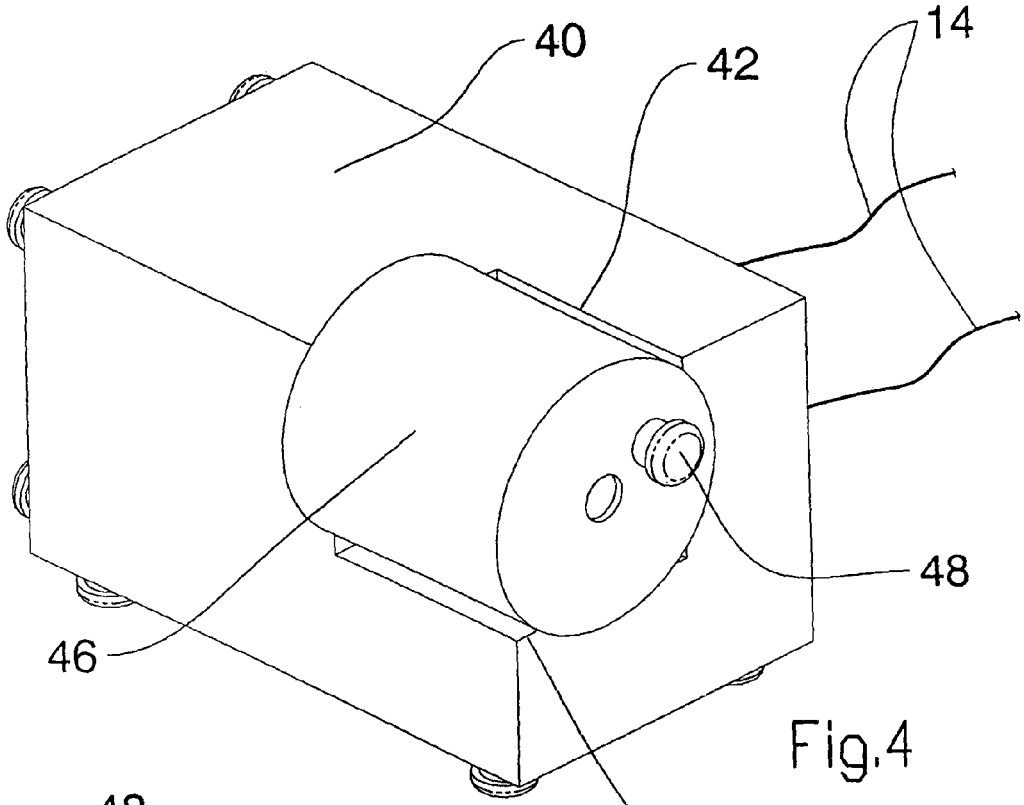
FIG. 4 is a schematic illustration of an alternate embodiment.
Figure 5:
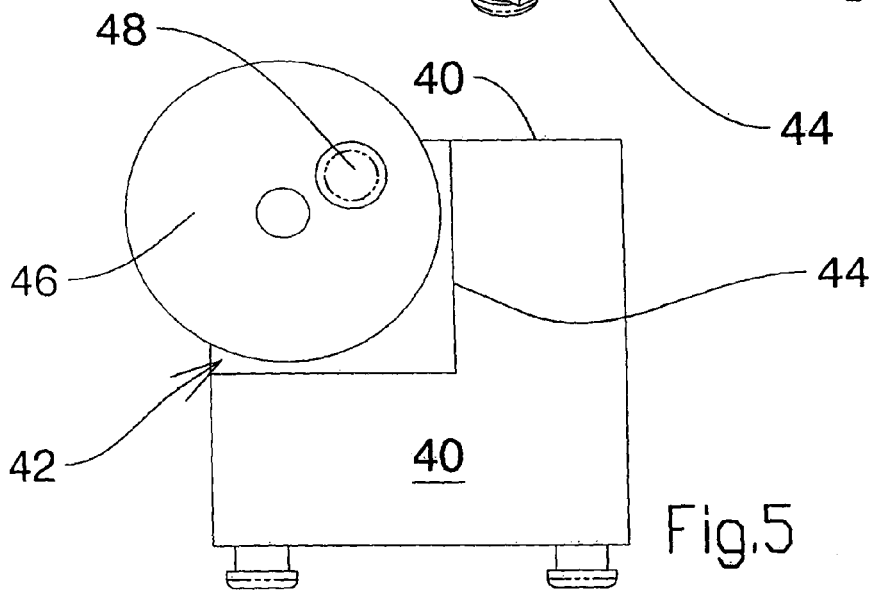
FIG. 5 is an end view on the embodiment of FIG. 4.

A further embodiment is shown in FIG. 4 and FIG. 5. In some cases the musician may find that it is more convenient to use the control with the roller in a vertical orientation. In this cases he would simply place his foot on the end on the roller, and twist his foot from side to side.

This will produce a rotation of the roller shaft, and thus a variation of the musical effect. In this embodiment the housing (40) has a recess (42), as before, but the recess is open as at (44) on one side (or end) of the housing.

The housing would preferably have floor friction elements (40) on both its underside and on one end, as shown.

The roller (46) is mounted in the notch (44) and extends outwardly from the housing both on its upper and side surfaces, and at one end surface. It may have a frictional surface material, to facilitate control by the sole of a shoe without slipping.

A button (48) may be provided on the exposed end surface of the roller, for convenient operation of the roller, in its upright mode.

Figure 6:
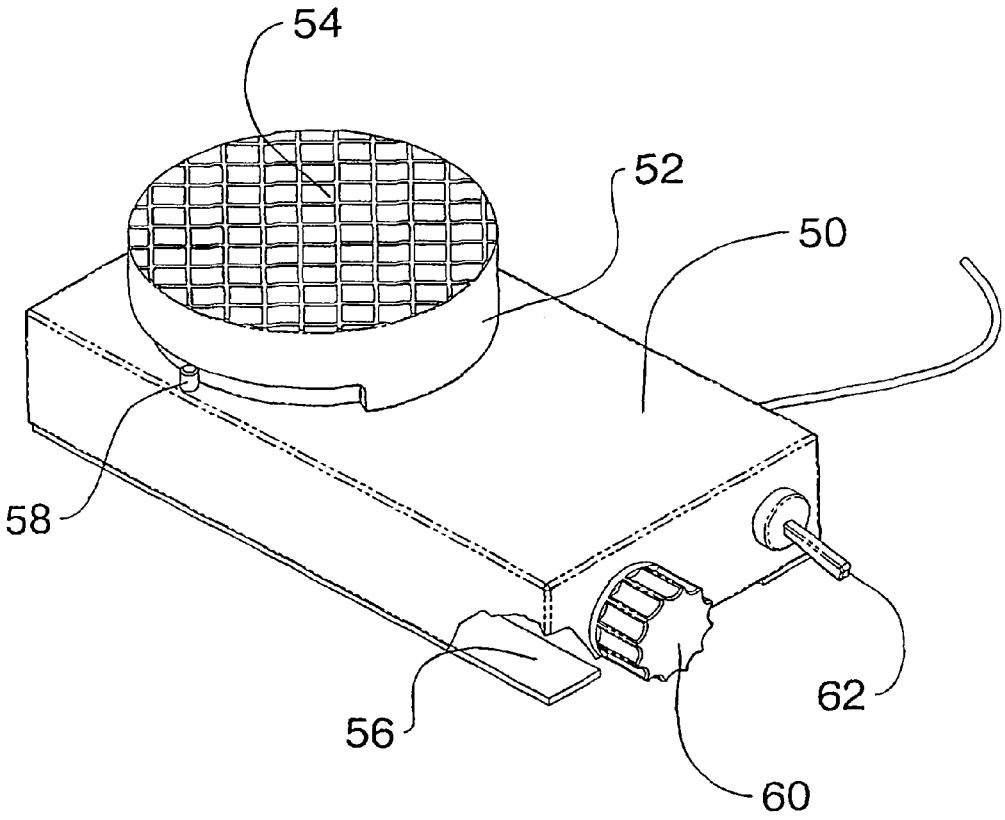
FIG. 6 is a perspective of an alternate embodiment, showing a roller mounted with one flat side uppermost, enabling the foot to rest on the upper flat side of the roller.

This same function could also be achieved in the alternate embodiment shown in FIG. 6. In this case the housing (50) has a somewhat different profile, being lower, and the roller (52) is mounted on a vertical shaft (not shown). The upper flat side surface (54) of the roller has a friction surface, for contact by the shoe.

Friction strips (56) on the underside will hold the housing steady when used. In fact they may grip on a typical mounting panel or board, (not shown) such as is well known and used by various players. A stop (58) limits the arc of travel of the roller.

The effect variable controlled by the controller, may be varied by, for example, the knob (60). An on/off switch (62) may be provided, where it will be of assistance.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A foot control for control of musical effects from a musical instrument, the instrument having an electrical signal output operable to send signals to a speaker system, said control comprising;

a housing adapted to be placed on the floor, the housing defining at least one side wall;

a roller rotatably mounted in the housing;

a roller surface portion exposed and extending away from said housing for contact by a foot, to enable rotation of said roller by said foot; and, circuitry within said housing connectable with said instrument and operable in response to rotation of the roller, to vary signals from said instrument;

wherein said housing is of generally rectangular box like shape, defined by side walls, end walls, and a top wall, and a notch being formed in at least one of said side and end walls and in the top wall so that said surface portion of said roller is exposed and extended outwardly from the housing, for contact by the foot.

2. A foot control for control of musical effects from a musical instrument, as claimed in claim 1 wherein a roller axis axle is carried by said housing.

3. A foot control for control of musical effects from a musical instrument, as claimed in claim 1 including a drive reduction system in said housing connecting said roller with said circuitry.

4. A foot control for control of musical effects from a musical instrument, as claimed in claim 1 including an electrical component forming part of said circuitry, which is rotatable, and at least one gear connecting said roller with said rotatable electrical component.

5. A foot control for control of musical effects from a musical instrument, as claimed in claim 4 including a drive gear on the roller axle, and a driven gear on the rotatable component, and at least one intermediate gear between the drive gear and the driven gear, the ratios of the gears being selected to provide an extended range of rotation of the rotatable electrical component.

6. A foot control for control of musical effects from a musical instrument, as claimed in claim 1 wherein an end portion of said roller is exposed outwardly from one wall of said housing, for contact by a foot.

7. A foot control for control of musical effects from a musical instrument, as claimed in claim 1 including friction elements on said housing for contacting a floor.

8. A foot control for control of musical effects from a musical instrument, as claimed in claim 1 wherein said circuitry includes a potentiometer, and a rotatable shaft extending from said potentiometer.

9. A foot control for control of musical effects from a musical instrument, as claimed claim 6 including a button on an end of the roller.

10. A foot control for control of musical effects from a musical instrument, the instrument having an electrical signal output operable to send signals to a speaker system, said control comprising;

a housing adapted to be placed on the floor, the housing defining at least one side wall;

a roller rotatably mounted in the housing;

a notch in said side wall, and wherein said roller is located partially within said notch;

a roller surface portion exposed and extending away from said housing for contact by a foot, to enable rotation of said roller by said foot; and, circuitry within said housing connectable with said instrument and operable in response to rotation of the roller, to vary signals from said instrument;

a potentiometer forming part of said circuitry;

a rotatable shaft extending from said potentiometer; and, at least one gear connecting said roller with said rotatable shaft.

* * * * *